US011911821B2

(12) United States Patent
Fujiwara et al.

(10) Patent No.: US 11,911,821 B2
(45) Date of Patent: Feb. 27, 2024

(54) COMPRESSED POWDER BODY COMPRISING SOFT MAGNETIC ALLOY

(71) Applicant: TOKIN CORPORATION, Sendai (JP)

(72) Inventors: Mariko Fujiwara, Sendai (JP); Kaori Ohdaira, Sendai (JP); Chieko Fujimoto, Sendai (JP); Kenichi Chatani, Sendai (JP)

(73) Assignee: TOKIN CORPORATION, Miyagi (JP)

( * ) Notice: Subject to any disclaimer, the term of this patent is extended or adjusted under 35 U.S.C. 154(b) by 0 days.

(21) Appl. No.: 17/990,044

(22) Filed: Nov. 18, 2022

(65) Prior Publication Data

US 2023/0166325 A1 Jun. 1, 2023

(30) Foreign Application Priority Data

Nov. 26, 2021 (JP) ..... 2021-192067

(51) Int. Cl.
*B22F 1/05* (2022.01)
*B22F 1/0655* (2022.01)
*B22F 1/105* (2022.01)

(52) U.S. Cl.
CPC ..... *B22F 1/0655* (2022.01); *B22F 1/05* (2022.01); *B22F 1/105* (2022.01); *B22F 2301/052* (2013.01); *B22F 2301/35* (2013.01); *B22F 2302/256* (2013.01)

(58) Field of Classification Search
CPC ..... B22F 1/05; B22F 1/0655
See application file for complete search history.

(56) References Cited

U.S. PATENT DOCUMENTS 10,515,751 B2 12/2019 Chatani et al.
2017/0117081 A1* 4/2017 Chatani ..... H01F 27/255
2020/0303106 A1 9/2020 Suetsuna et al.

FOREIGN PATENT DOCUMENTS

JP 2015175047 A 10/2015
JP 2020155525 A 9/2020
WO WO-2017022595 A1 * 2/2017 ..... B22F 1/0011
WO WO-2020195842 A1 * 10/2020 ..... B22F 1/00

OTHER PUBLICATIONS

Translation WO 2017022595 A1 (Year: 2017).*

* cited by examiner

*Primary Examiner* — Hoa (Holly) Le
(74) *Attorney, Agent, or Firm* — Holtz, Holtz & Volek PC

(57) ABSTRACT

A compressed powder body comprises metal particles and an interposed substance which is interposed between the metal particles. Each of the metal particles is made of FeSiAl-based soft magnetic alloy and has a flat shape when seen along a predetermined direction. The metal particles include one or more of the metal particles each of which is formed with one or more predetermined holes. Each of the predetermined holes passes through the metal particle in the predetermined direction. Each of the predetermined holes has a maximum width in a predetermined plane perpendicular to the predetermined direction the maximum width being equal to or larger than a thickness of the metal particle with the predetermined hole in the predetermined direction.

7 Claims, 5 Drawing Sheets

COMPRESSED POWDER BODY COMPRISING SOFT MAGNETIC ALLOY

CROSS REFERENCE TO RELATED APPLICATIONS

This application is based on and claims priority under 35 U.S.C. § 119 to Japanese Patent Application No. JP 2021-192067 filed Nov. 26, 2021, the content of which is incorporated herein in its entirety by reference.

BACKGROUND OF THE INVENTION

This invention relates to a compressed powder body comprising plurality of metal particles and an interposed substance which is interposed between the metal particles.

For example, this type of compressed powder body is disclosed in JP 2015-175047A (Patent Document 1), the content of which is incorporated herein by reference.

Patent Document 1 discloses a soft magnetic molded body (compressed powder body) comprising soft magnetic metal particles which have flat shapes and are bound by a binder component (interposed substance). The compressed powder body of Patent Document 1 has good magnetic properties such as low core loss at a frequency of about 1 MHz and can be used as a magnetic component such as an inductor.

There is a request for a magnetic component which has lower core loss at higher frequency. This magnetic component is also required to have good direct-current (DC) superimposition characteristics. Thus, there is a request for a compressed powder body which can be used as the magnetic component having such magnetic properties.

SUMMARY OF THE INVENTION

It is therefore an object of the present invention to provide a compressed powder body which has low core loss in high-frequency range and good DC superimposition characteristics.

An aspect of the present invention provides a compressed powder body comprising metal particles and an interposed substance which is interposed between the metal particles. Each of the metal particles is made of FeSiAl-based soft magnetic alloy and has a flat shape when seen along a predetermined direction. The metal particle includes one or more of the metal particles each of which is formed with one or more predetermined holes. Each of the predetermined holes passes through the metal particle in the predetermined direction. Each of the predetermined holes has a maximum width in a predetermined plane perpendicular to the predetermined direction, the maximum width being equal to or larger than a thickness of the metal particle with the predetermined hole in the predetermined direction.

The compressed powder body of an aspect of the present invention contains one or more metal particles each of which has a flat shape and is formed with a predetermined hole (through hole) of a predetermined size. The metal particles are bound by an interposed substance. Core loss of the compressed powder body can be reduced in high-frequency range of several MHz or more by forming the through holes in the flat metal particles. In addition, DC superimposition characteristics of the compressed powder body can be improved. Thus, an aspect of the present invention provides a compressed powder body which has low core loss in high-frequency range and good DC superimposition characteristics.

An appreciation of the objectives of the present invention and a more complete understanding of its structure may be had by studying the following description of the preferred embodiment and by referring to the accompanying drawings.

Figure 1:
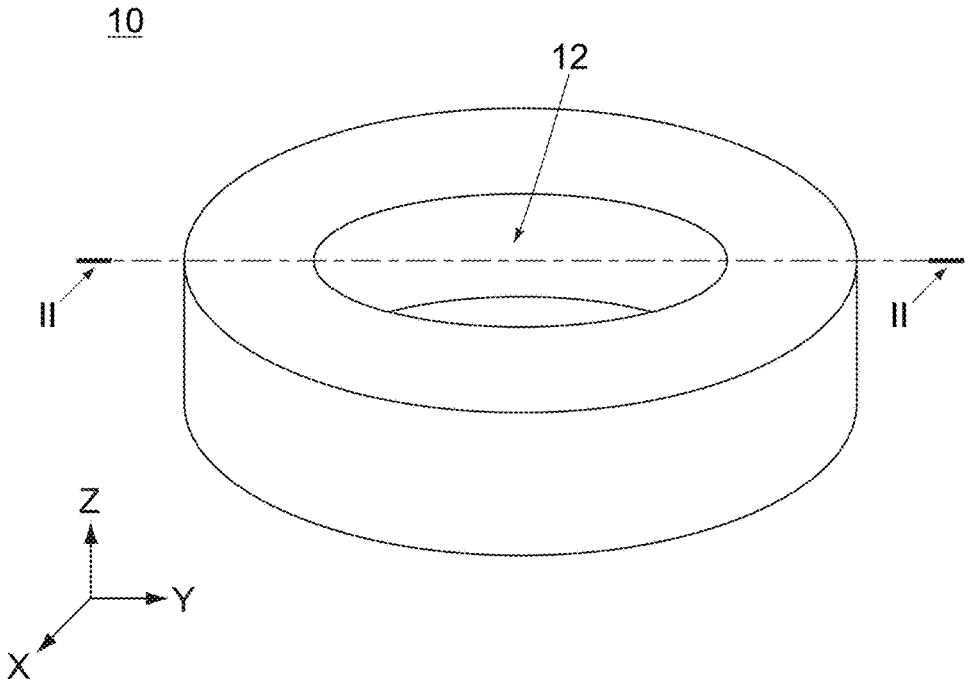
FIG. 1 is a view showing an example of a compressed powder body of an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Referring to FIG. 1, a compressed powder body 10 of the present embodiment is a dust core. The dust core of the present embodiment has a toroidal shape. In detail, the compressed powder body 10 has a circular ring shape in a horizontal plane (XY-plane). The compressed powder body 10 is formed with a central hole 12. The central hole 12 has a circular shape in the horizontal plane and passes through the compressed powder body 10 in a predetermined direction perpendicular to the horizontal plane. The predetermined direction of the present embodiment is an upper-lower direction and is the Z-direction. In the present embodiment, "upward" means the positive Z-direction, and "downward" means the negative Z-direction. Various words indicating positional relations such as "horizontal", "upper" and "lower" do not show absolute positional relations relative to the earth but merely show relative positional relations in the figures.

As described above, the compressed powder body 10 of the present embodiment is a magnetic core having a toroidal shape. However, the present invention is not limited thereto but is applicable to various magnetic components other than the magnetic core. For example, the compressed powder body 10 according to the present invention may be a magnetic sheet. The shape of the compressed powder body 10 according to the present invention is not specifically limited.

Figure 2:
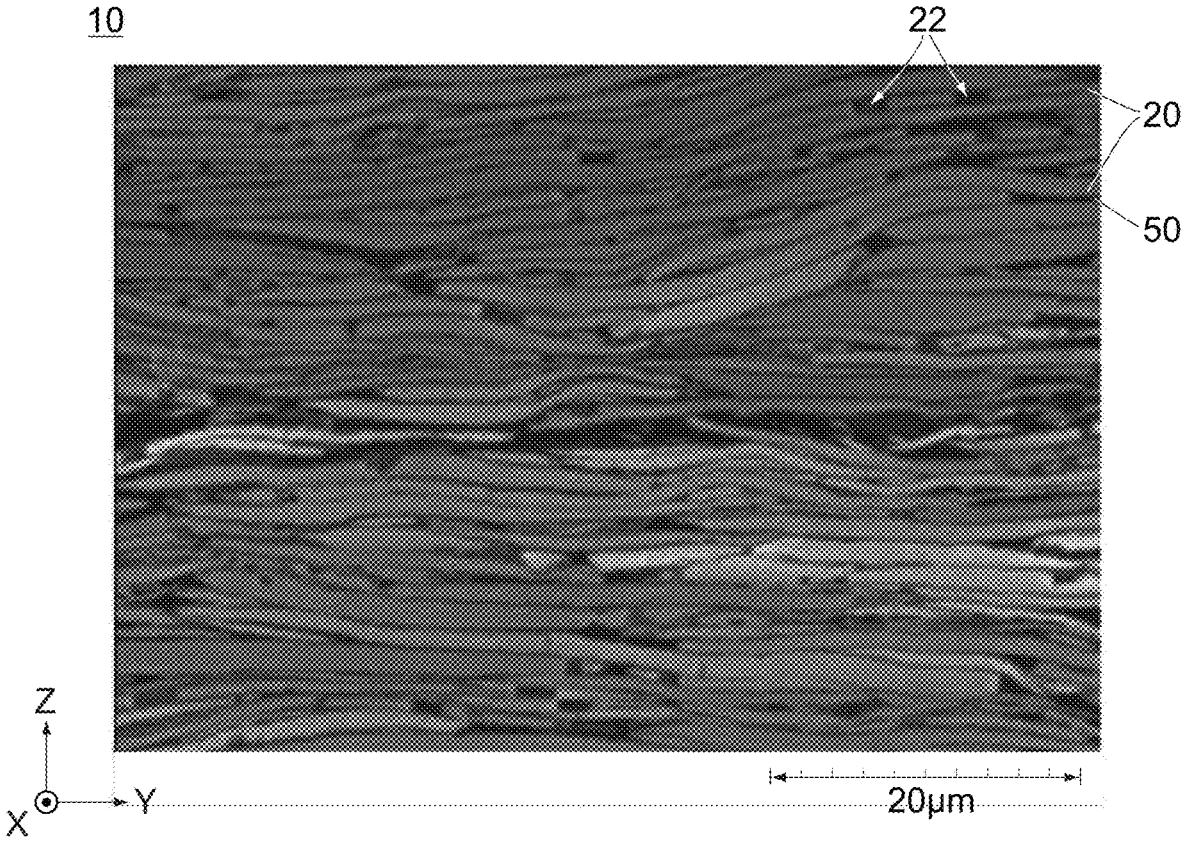
FIG. 2 is an image showing a part of the example of the compressed powder body of FIG. 1, taken along line II-II.

Referring to FIG. 2, the compressed powder body 10 comprises metal particles 20 and an interposed substance 50 which is interposed between the metal particles 20. As described later, the compressed powder body 10 of the present embodiment is made by applying a heat-treatment to a mixture of the metal particles 20 and a thermosetting binder containing inorganic substance (hereafter, simply referred to as "binder"). The binder is chemically changed into the interposed substance 50 of the present embodiment during the heat-treatment. The interposed substance 50 is formed with pores (vacancy) having various shapes.

The compressed powder body 10 of the present embodiment is formed of the metal particles 20, the interposed substance 50 and the vacancy. In detail, the compressed powder body 10 of the present embodiment contains the metal particles 20 of 60 volume % or more, the interposed substance 50 of not less than 4 volume % but not more than 30 volume % and the vacancy of not less than 10 volume % but not more than 30 volume %. The compressed powder body 10 contains a sufficient amount of the metal particles 20 and has magnetic properties required for a magnetic core. However, the present invention is not limited thereto. For example, the volume ratio of the metal particles 20 relative to the compressed powder body 10 is not specifically limited, provided that the compressed powder body 10 has sufficient magnetic properties required for its use. The compressed powder body 10 may contain another substance in addition to the metal particles 20 and the interposed substance 50.

Figure 3:
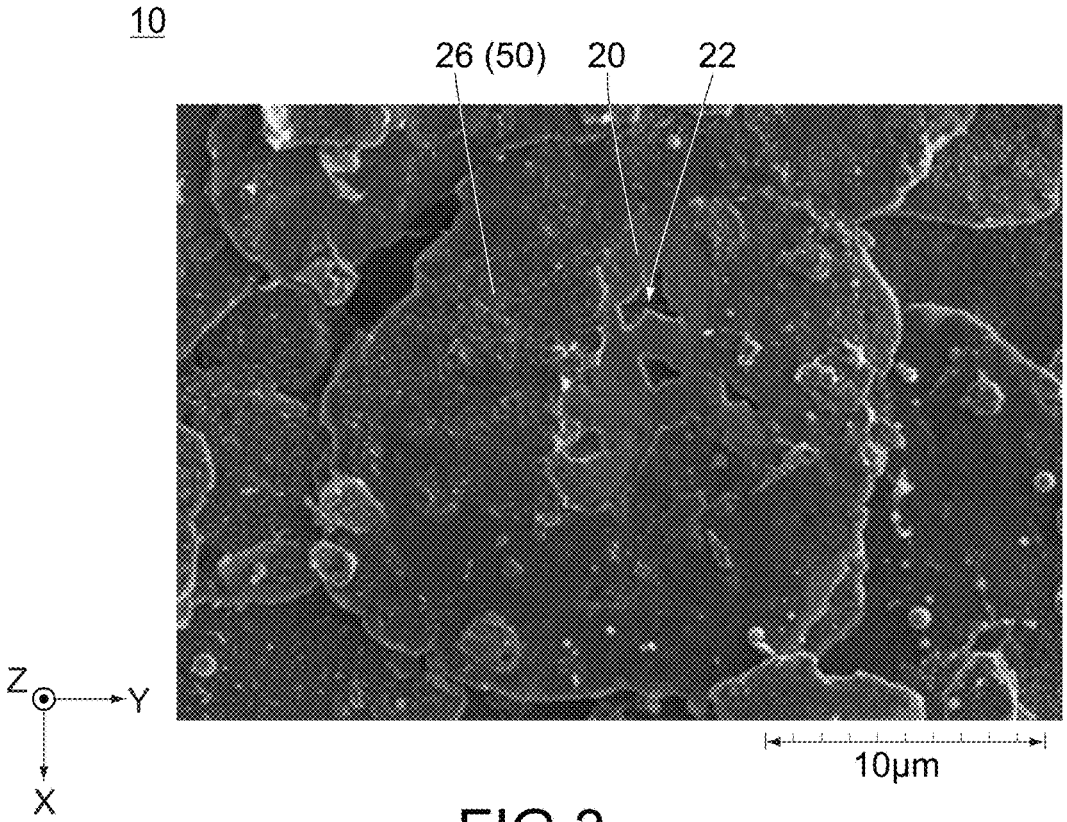
FIG. 3 is an image showing metal particles contained in the example of FIG. 2, wherein the image is taken by electron microscopy at an applied voltage of 5 kV.
Figure 4:
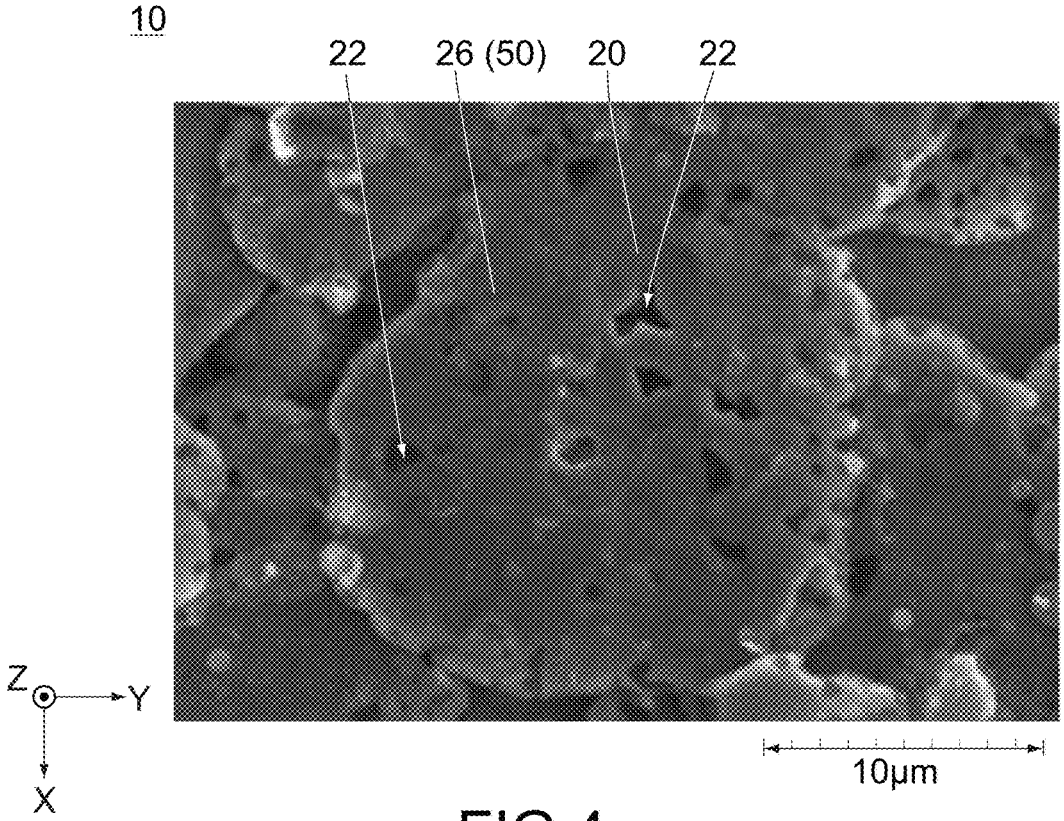
FIG. 4 is an image showing metal particles of FIG. 3, wherein the image is taken by electron microscopy at an applied voltage of 15 kV.

Referring to FIGS. 2 to 4, each of the metal particles 20 has a flat shape when seen along the predetermined direction (upper-lower direction). Each of the metal particles 20 of the compressed powder body 10 is arranged to be in parallel to the horizontal plane. The thus-formed compressed powder body 10 has an axis of easy magnetization which extends along a direction in parallel to the horizontal plane. The thus-extending axis of easy magnetization lowers demagnetization factor of the compressed powder body 10 in the direction in parallel to the horizontal plane, and thereby relative permeability of the compressed powder body 10 can be made high. More specifically, the compressed powder body 10 of the present embodiment has relative permeability of not less than 60 but not more than 150 under a state where magnetic field is not applied.

The interposed substance 50 is partially formed granularly while being partially formed planarly to spread over opposite surfaces, i.e., upper and lower surfaces, of each of the metal particles 20. The thus-formed interposed substance 50 exists all over the compressed powder body 10 and binds the metal particles 20 together.

Each of the metal particles 20 is made of sendust, or FeSiAl-based soft magnetic alloy. In other words, each of the metal particles 20 contains Fe, Si and Al as its essential element. Each of the metal particles 20 may contain another element in addition to Fe, Si and Al. From a viewpoint of obtaining magnetic properties required for a magnetic component, each of the metal particles 20 should contain Fe as its main element. Fe ratio of the metal particles 20 is preferred to be not less than 70 weight % but not more than 95 weight %. Si ratio of the metal particles 20 is preferred to be not less than 3 weight % but not more than 18 weight %. Al ratio of the metal particles 20 is preferred to be not less than 1 weight % but not more than 12 weight %. However, the present invention is not limited thereto. For example, each of Si ratio and Al ratio of the metal particles 20 is not specifically limited, provided that the compressed powder body 10 has required magnetic properties.

The metal particles 20 of the compressed powder body 10 include one or more of the metal particles 20 each of which is formed with one or more predetermined holes 22 satisfying conditions described later. In other words, each of one or more of the metal particles 20 is formed with one or more of the predetermined holes 22. The metal particle 20 which is formed with the predetermined hole 22 schematically has a structure illustrated in FIGS. 5 and 6. The illustrated metal particle 20 has an elliptical shape in the horizontal plane and has a constant size, namely a thickness TP, in the predetermined direction (upper-lower direction). The illustrated metal particle 20 extends entirely in parallel to the horizontal plane. However, the present invention is not limited thereto. For example, the actual metal particles 20 have various shapes in the horizontal plane. The thickness TP of each of the actual metal particles 20 slightly varies depending on its part. Each of the metal particles 20 may extend in parallel to the horizontal plane as a whole while curving in the predetermined direction.

Figure 5:
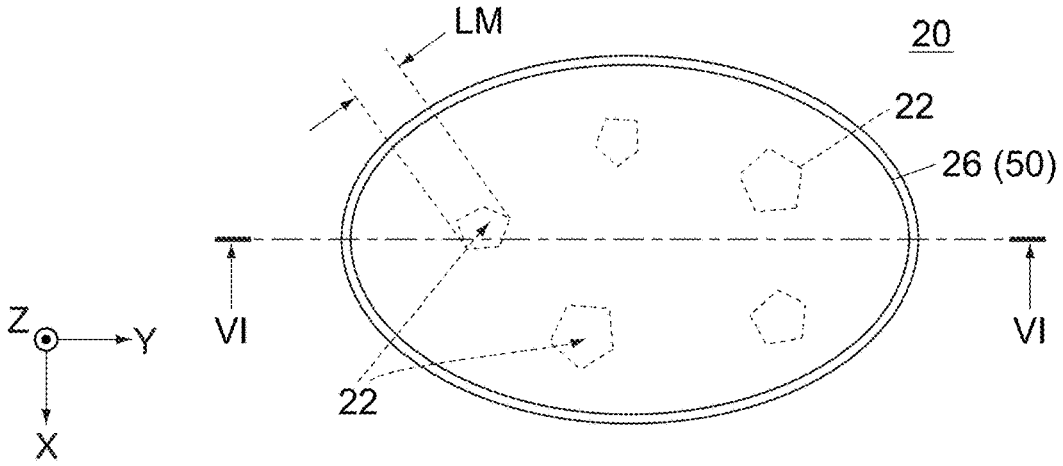
FIG. 5 is a top view schematically showing the metal particle of FIG. 3, wherein an outline of a predetermined hole hidden by an oxide film is illustrated with dashed line.
Figure 6:
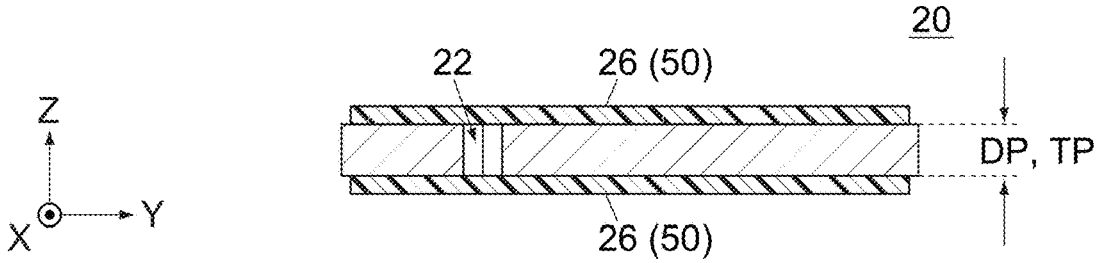
FIG. 6 is a cross-sectional view showing the metal particle of FIG. 5, taken along line VI-VI.

Referring to FIGS. 5 and 6, each of predetermined holes 22 passes through the metal particle 20 in the predetermined direction (upper-lower direction). Each of the illustrated predetermined holes 22 has a pentagon shape in the horizontal plane and has a constant cross-sectional shape regardless of its position in the predetermined direction. Each of the illustrated predetermined holes 22 passes through the metal particle 20 straight along the predetermined direction. However, the present invention is not limited thereto. For example, each of predetermined holes 22 may have a rectangular shape, a trapezoidal shape or a triangular shape in the horizontal plane. The horizontally cross-sectional shape of each of the predetermined holes 22 may vary to some extent depending on its position in the predetermined direction. Each of the predetermined holes 22 may pass through the metal particle 20 along a direction oblique to the predetermined direction or may pass through the metal particle 20 while curving.

Each of the predetermined holes 22 has a relatively large size in the horizontal plane. In detail, the predetermined hole 22 has a maximum width LM in the horizontal plane, or a predetermined plane perpendicular to the predetermined direction (upper-lower direction), the maximum width LM being equal to or larger than the thickness TP of the metal particle 20 with the predetermined hole 22 in the predetermined direction. In other words, each of the predetermined holes 22 is a through hole which is formed in the metal particle 20 and meets the aforementioned size condition. Each of the metal particles 20 may be formed with a narrow hole in addition to the predetermined hole 22 which meets this condition. Each of the metal particles 20 may be formed with a recess. For example, these narrow hole and recess are easily formed in a circumference of the metal particle 20.

When various horizontal cross-sections of the predetermined hole 22 are observed, the maximum width LM is a distance between two points which are located in one of the observed horizontal cross-sections and are most apart from each other in comparison with any other two points in each of the observed horizontal cross-sections. Thus, the maximum width LM of the predetermined hole 22 is a maximum distance between two points of the upper edge of the predetermined hole 22, a maximum distance between two points of the lower edge of the predetermined hole 22 or a maximum distance between two points of the middle of the predetermined hole 22 in the predetermined direction (upper-lower direction).

The thickness TP of the metal particle 20 is exactly the maximum value of thicknesses, or sizes in the predetermined direction (upper-lower direction), of parts of the metal particle 20 which surround the predetermined hole 22. However, the metal particle 20 has a nearly constant thickness except for its circumference. In particular, it can be considered that the metal particle 20 has a substantially constant thickness in a narrow region such as a part around the predetermined hole 22. Thus, the thickness TP can be considered to be equal to a depth DP which is a size of the predetermined hole 22 in the predetermined direction.

Each of the predetermined holes 22 of the present embodiment opens outward from the metal particle 20 at opposite ends, i.e., upper and lower ends, thereof in the predetermined direction (upper-lower direction). However, the opposite surfaces, i.e., the upper and lower surfaces, of the illustrated metal particle 20 are covered by thin oxide films 26 in the predetermined direction, respectively. The oxide films 26 are parts of the interposed substance 50 which planarly spread along the opposite surfaces of the metal particle 20. Thus, each of the oxide films 26 is a part of the interposed substance 50 and covers the opening of the predetermined hole 22.

The oxide films 26 are parts of the interposed substance 50 which cover the opposite surfaces of the metal particle 20 in a manufacturing process of the compressed powder body 10. Usually, the upper and lower ends of each of the predetermined holes 22 of the present embodiment are wholly covered by the oxide films 26. Thus, each of the predetermined holes 22 has the opposite ends in the predetermined direction (upper-lower direction) each of which is covered by a part of the interposed substance 50. However, the oxide film 26 has an extremely thin film thickness of about 10 to 100 nm. Referring to FIG. 3, when an applied voltage of an electron microscopy is low as about 5 kV, the predetermined holes 22 are covered by and hidden behind the oxide films 26 except for the predetermined holes 22 located in a region where the oxide film 26 is peeled off upon delamination for observation. In contrast, referring to FIG. 4, when an applied voltage of an electron microscopy is high as about 15 kV, the predetermined holes 22 covered by the oxide film 26 can be observed.

Referring to FIGS. 5 and 6, according to the present embodiment, each of the predetermined holes 22 is a closed space covered by the oxide films 26. However, the present invention is not limited thereto. For example, each of the predetermined holes 22 may be partially covered by the oxide films 26 or may not be covered at all by the oxide films 26.

Each of the predetermined holes 22 of the present embodiment is hollow. No tangible substance such as the interposed substance 50 exists in each of the predetermined holes 22. However, the present invention is not limited thereto. For example, each of the predetermined holes 22 may be filled with a part of the interposed substance 50.

Figure 7:
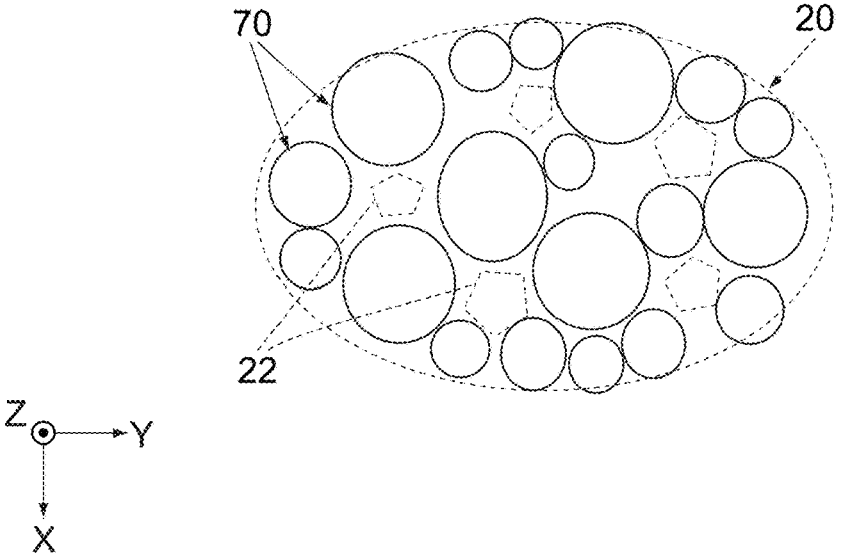
FIG. 7 is a top view for explaining magnetic properties of the metal particle of FIG. 5.

Referring to FIG. 7, the predetermined hole 22 is considered to divide the one metal particle 20 having a flat shape into a plurality of fine sphere particles, or a plurality of imaginary particles 70 each having a sphere shape. According to this consideration, the metal particles 20 each formed with the predetermined hole 22 will have magnetic properties intermediate between magnetic properties of the flat particles which is the existing particles having flat shapes and magnetic properties of the existing fine sphere particle. This consideration can be tested as described below.

Figure 8:
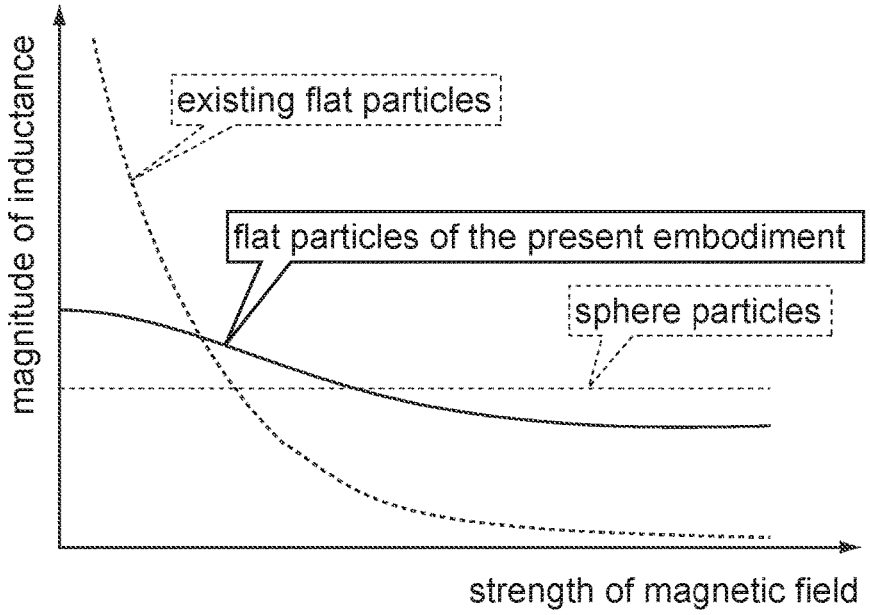
FIG. 8 is a view showing DC superimposition characteristics of the metal particle of FIG. 5.

Referring to FIG. 8, the existing flat particles have high inductance under a state where no magnetic field is applied, but its inductance is rapidly degraded when magnetic field is applied. The existing fine sphere particles have low inductance under a state where no magnetic field is applied, but its inductance is hardly degraded even when magnetic field is applied. Thus, the existing fine sphere particles have extremely good DC superimposition characteristics in comparison with the existing flat particles.

Referring to FIG. 8 together with FIG. 7, the flat particles of the present embodiment which include the metal particles 20 each formed with the predetermined hole 22 have inductance which is lower than that of the existing flat particles but is higher than that of the existing fine sphere particles under a state where no magnetic field is applied. In addition, the inductance of the flat particles of the present embodiment is hardly degraded even when magnetic field is applied. Such DC superimposition characteristics cannot be obtained even if the existing flat particles and the existing fine sphere particles are mixed.

The test result shown in FIG. 8 suggests that the aforementioned consideration is correct. In detail, by forming the predetermined hole 22 in the flat metal particle 20, the magnetic domain structure of the flat metal particle 20 is changed from the magnetic domain structure of the existing flat particle to the magnetic domain structure of a flat-plate structure including high density of the fine sphere particles. As a result, DC superimposition characteristics intermediate between the existing flat particle and the existing fine sphere particle can be obtained. In addition, referring to Example 1 of FIG. 10, because the magnetic domain structure is made fine, core loss is reduced in high-frequency range between 1 MHz and Summarizing the explanation described above with reference to FIGS. 2 to 4, the compressed powder body 10 of the present embodiment is formed of the flat metal particles 20 and the interposed substance 50. The interposed substance 50 binds the flat metal particles 20 which include the metal particles 20 each having the predetermined hole 22 (through hole) of the predetermined size. By forming the through holes in the flat metal particles 20, core loss of the compressed powder body 10 can be reduced in high-frequency range of several MHz or more. In addition, DC superimposition characteristics of the compressed powder body 10 can be improved. Thus, the present embodiment provides the compressed powder body 10 which has low core loss in high-frequency range and good DC superimposition characteristics.

When the metal particle 20 which is formed with one or more of the predetermined holes 22 is defined as "predetermined metal particle 20", all the metal particles 20 contained in the compressed powder body 10 may be the predetermined metal particles 20, or only some of the metal particles 20 may be the predetermined metal particles 20. According to the present embodiment, ratio of the number of the predetermined metal particles 20 relative to the number of all the metal particles 20 contained in the compressed powder body 10 is about 5%. When the compressed powder body 10 contains such amount of the predetermined metal particles 20, the compressed powder body 10 has low core loss in high-frequency range and good DC superimposition characteristics. However, the present invention is not limited thereto. For example, the ratio of the predetermined metal particles 20 relative to all the metal particles 20 contained in the compressed powder body 10 may be 5% or more. More specifically, in a scanning electron microscope (SEM) image in which a cross-section of the compressed powder body 10 is magnified 2000 times, the ratio of the predetermined metal particles 20 relative to the metal particles 20 observed within a view range of 60×45 μm may be 5% or more.

Hereafter, explanation will be made about an example of a manufacturing method of the compressed powder body 10 with reference to FIG. 2.

First, soft magnetic metal powder of a flat shape is made. For example, this soft magnetic metal powder can be formed of material powder which is soft magnetic metal powder made of FeSiAl alloy and having a sphere shape. This material powder can be flattened by using a ball-mill.

Then, a mixture of the flattened material powder, a solvent, a viscosity improver and a binder is made. For example, ethanol and polyacrylic acid ester can be used as the solvent and the viscosity improver, respectively. For example, methyl silicone resin can be used as the binder. The mixture is sufficiently mixed so that a homogeneous slurry is made. For example, the mixture is put into a container having a diameter of 150 mm and a liquid level depth of 150 mm. For example, a rotating blade having a diameter length of 100 mm stirs the mixture in the container at a relatively high rotational speed (250 rpm, for example) during a relatively long hours (5 hours, for example) so that the homogeneous slurry can be made.

Then, the slurry is applied on a substrate. For example, a doctor blade method can be used as the application method. For example, a polyethylene terephthalate (PET) film can be used as the substrate. The applied slurry is heat-treated, and thereby the solvent is removed. As a result, a sheet-like preliminary body, which is material of the compressed powder body 10, is made. Because the preliminary body is not made of brittle material, the preliminary body can be pressure-molded. Each of the metal particles 20 in the preliminary body is arranged to be in parallel to the horizontal plane.

Then, the preliminary body is cut so that a necessary number of sheets each having a necessary size are made. Then, the sheets are stacked on each other in the predetermined direction (upper-lower direction). The thus-stacked sheets are compressed by pressure along the predetermined direction so that a pressure-molded body is made. For example, the pressure-molded body is made as a result of two times pressing in a die which includes a room temperature pressing and a hot pressing. The metal particles 20 are close to each other in the pressure-molded body. Two of the metal particles 20 which are vertically close to each other extend in parallel to each other with a part of the binder sandwiched therebetween in the predetermined direction.

Then, the pressure-molded body is heat-treated at a high temperature. For example, this heat-treatment is performed in the atmosphere. For example, the maximum holding temperature in this heat-treatment is 850° C. As a result of the heat-treatment, the binder is hardened while its organic component is decomposed to be lost. More specifically, the methyl silicone resin is dehydration-condensed, and its methyl group is pyrolytically decomposed. The thus-hardened binder is formed of silica which contains silicon dioxide ($SiO_2$) as its main component and contains a slight amount of Fe and Al. The thus-formed silica works as the interposed substance 50 and fills the space located between the metal particles 20 so as to bind the metal particles 20 together.

The compressed powder body 10 of the present embodiment can be made by the aforementioned steps described above.

Figure 9:
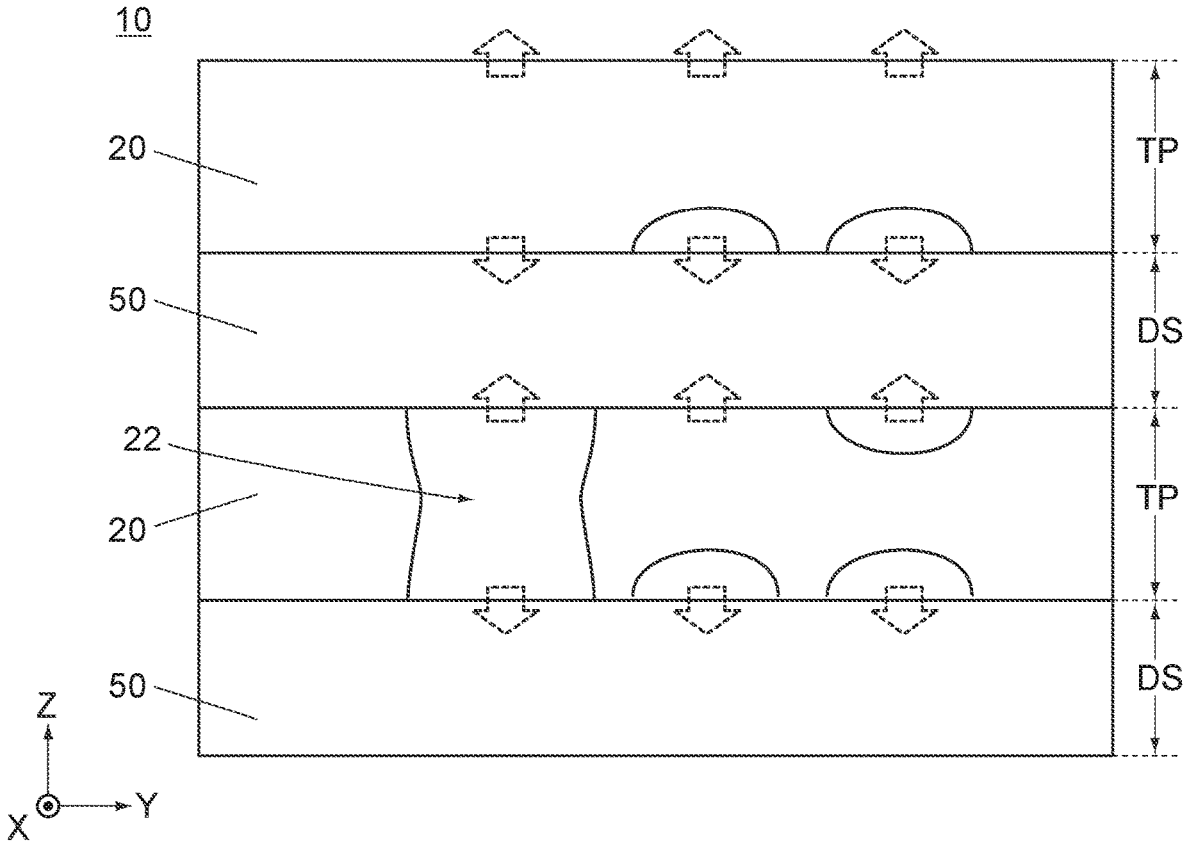
FIG. 9 is a view showing a process in which the predetermined hole of the metal particle of FIG. 5 is formed.

Referring to FIG. 9, as a result of the pressing along the predetermined direction (upper-lower direction), the metal particles 20 which are vertically overlap with each other extend in parallel to each other while being apart from each other by a distance DS of 0.5 μm or less in the predetermined direction. In addition, during a process in which the temperature of the pressure-molded body is raised to a high temperature such as 850° C., the interposed substance 50 (silica) made of the binder fills the space located between vertically stacked two of the metal particles 20 substantially with no gap. Thus, the silicon oxide, which is the main component of the interposed substance 50, is in contact with each of the metal particles 20 so as to spread over the opposite surfaces, i.e., the upper and lower surfaces, of each of the metal particles 20. When the pressure-molded body is held at the high temperature such as 850° C., the metal particles 20 and the interposed substance 50 have been arranged as described above.

Al element of the elements contained in the metal particle 20 is easily oxidized in comparison with the other elements contained in the metal particle 20 and is easily oxidized even in comparison with the other elements such as Cr element. While the pressure-molded body is held at the high temperature such as 850° C., the Al element contained in each of the metal particles 20 is diffused to the opposite surfaces of the metal particle 20 and is selectively oxidized to form Al oxide film which contains Al element as its main component. Al element is further diffused into the interposed substance 50 through the opposite surfaces of each of the metal particles 20 (see the dashed arrow in FIG. 9). As a result of this diffusion, each of the metal particles 20 is formed with the predetermined hole 22. The predetermined hole 22 of the present embodiment is considered to be formed as described above. However, Fe element is also considered to be diffused in the Al oxide film to form Fe oxide film located outside the Al oxide film. Thus, Fe element is also considered to contribute to formation of the predetermined hole 22 to some extent.

As can be seen from the explanation described above, in order for each of the metal particles 20 to be formed with the predetermined hole 22, the holding temperature in the heat-treatment of the pressure-molded body should be high enough to allow the elements to be diffused. However, when the holding temperature is made excessively high, the metal particles 20 might be directly bound together, and thereby the metal particles 20 might be insufficiently insulated from each other. More specifically, the holding temperature according to the present embodiment should be about 850° C.

When the metal particle 20 has a flat shape, the elements in the metal particle 20 can be easily diffused to the surfaces thereof. In other words, the metal particle 20 is preferred to be a flat particle in order to be formed with the predetermined hole 22. More specifically, aspect ratio of each of the metal particles 20, which is a maximum width of the metal particle 20 along its surface divided by the average thickness of the metal particle 20, is preferred to be 10 or more and is further preferred to be 20 or more. However, when the aspect ratio is too large, the metal particle 20 is easily damaged in the making process of the compressed powder body 10. Therefore, the aspect ratio of each of the metal particles 20 is preferred to be 50 or less and is further preferred to be 40 or less. Thus, according to the present embodiment, the aspect ratio of each of the metal particles 20 formed with the predetermined hole 22 is preferred to be between 10 and 50 (both inclusive) and is further preferred to be between 20 and 40 (both inclusive).

When the metal particle 20 is thick, the predetermined hole 22 is hardly formed. In other words, each of the metal particles 20 is preferred to be thin in order to be formed with the predetermined hole 22. More specifically, the thickness TP of each of the metal particle 20 is preferred to be 5 μm or less. However, each of the metal particles 20 should be thick to some extent so that the metal particles 20 can be prevented from being damaged in the making process of the compressed powder body 10. In particular, in an instance where the metal particles 20 include a large number of excessively crushed particles each having the thickness TP of smaller than 0.5 μm, density of the compressed powder body 10 is hardly increased. In addition, because each of these metal particles 20 is bulky, or has a large specific surface area, the pressure-molded body is hardly formed. Therefore, the thickness TP of each of the metal particles 20 is preferred to be 0.5 μm or more. Thus, according to the present embodiment, the thickness TP of each of the metal particles 20 formed with the predetermined hole 22 is preferred to be not less than 0.5 μm but not more than 5 μm.

Referring to FIG. 9 together with FIGS. 5, 6 and 7, in order for the aforementioned magnetic domain structure of the flat-plate structure to be formed, the total area of the predetermined holes 22 of each of the metal particles 20 is preferred to be 1% or more relative to the area of the metal particle 20 when the metal particle 20 is seen along the predetermined direction (upper-lower direction). Moreover, in order for the magnetic domain structure to be made sufficiently fine, the maximum width LM of each of the predetermined holes 22 is preferred to be 1 μm or more. However, in an instance where the maximum width LM of the predetermined hole 22 is more than 5 μm, Al element, Fe element and Si element diffused into the interposed substance 50 which is located between the metal particles 20 might work as sources of electrons and holes, and thereby insulation properties between the metal particles 20 might be lowered. Therefore, the maximum width LM of each of the predetermined holes 22 is preferred to be not less than 1 μm but not more than 5 μm.

Referring to FIG. 9, in order for the predetermined hole 22 to be formed, the interposed substance 50, which is in contact with the surfaces of the metal particles 20 and absorbs the diffused elements, is considered to be essential. The interposed substance 50 of the present embodiment contains silicon oxide as its main component, and the silicon oxide is considered to absorb the diffused elements of the metal particles 20 made of FeSiAl-based soft magnetic alloy. In detail, Si contained in the silicon oxide is considered to mainly contribute to formation of the predetermined hole 22 because of absorption of the diffused elements. However, the present invention is not limited thereto. For example, the interposed substance 50 may contain at least one of P, B, Bi, alkali metal such as Li, Na and K, and alkali-earth metal such as Mg, Ca, Sr and Ba as its essential element instead of Si or in addition to Si. These elements help formation of the predetermined hole 22.

For example, a glass frit may be used as the binder which forms the interposed substance 50 instead of methyl silicone resin or in addition to methyl silicone resin. This glass frit may contain at least one of P, B, Bi, alkali metal such as Li, Na and K, and alkali-earth metal such as Mg, Ca, Sr and Ba. More specifically, a $Bi_2O_3$—$B_2O_3$-based glass frit may be used, or a $P_2O_5$—$R_2O$—$Al_2O_3$-based glass frit (where R is at least one element selected from a group consisting of Li, Na and K) may be used. Each of these glass frits is temporarily melted in the heat-treatment and then forms glass. According to addition of material containing alkali metal, a glass transition point and a burning temperature can be lowered, and the glass can be improved in fluidity. According to addition of material containing alkali-earth metal, the glass has stable chemical durability and stable amorphous properties, for example.

Summarizing the explanation described above, the interposed substance 50 of the present embodiment is preferred to contain silicon oxide as its main component or to be made of glass. Thus, the binder of the present embodiment is preferred to contain at least one of the thermosetting resin containing Si and the glass frit. When mixed ratio of the glass frit in the binder is made high, the holding temperature in the heat-treatment can be lowered to about 600° C. As a result, the maximum holding temperature in the heat-treatment can be designed to 600° C. or more but 900° C. or less.

In an instance where the glass frit is contained in the binder, the glass frit having a large grain size is not preferable because density of the metal particles 20 in the slurry is lowered. When the glass frit is contained in the binder, the glass frit is preferred to be crushed into fine particles which have a grain size (D50) of about 0.95 μm.

According to the present embodiment, after the sheets are made, a plurality of the sheets are stacked on each other and are compressed. However, the present invention is not limited thereto. For example, the material powder may be granulated by coating a binder thereon and may be filled into a die. Thereafter, the-thus filled powder may be compressed. However, according to the manufacturing method of the present embodiment in which the thin sheet is made, the material powder is easily arranged along the horizontal plane and the binder is easily distributed homogeneously. As a result, each of the metal particles 20 is easily formed with the predetermined hole 22. Therefore, the manufacturing method of the present embodiment is preferable unless there is a particular reason.

Examples

Hereafter, further specific explanation will be made about the compressed powder body of the present invention with reference to Examples 1 to 19 and Comparative Examples 1 and 2. First, explanation will be made about a manufacturing method of Example 1 and Comparative Examples 1 and 2.

(Making of Material Powder of Each of Example 1 and Comparative Examples 1 and 2)

Sphere-like powder made of FeSiAl alloy was flattened so that material powder of each of Example 1 and Comparative Example 1 was made. In addition, sphere-like powder made of FeSiCr alloy was flattened so that material powder of Comparative Example 2 was made. The material powder of each of Example 1 and Comparative Example 1 had an average particle size of 50 μm and had an average aspect ratio of 29. The material powder of Comparative Example 2 had an average particle size of 16 μm and had an average aspect ratio of 32.

(Making of Slurry of Each of Example 1 and Comparative Examples 1 and 2)

The material powder of each of Example 1 and Comparative Examples 1 and 2 was used to make slurry. In detail, the material powder, a solvent, a viscosity improver and a binder were mixed into a mixture. The mixture was stirred so that homogeneous slurry was made. Ethanol was used as the solvent. Polyacrylic acid ester was used as the viscosity improver. Methyl silicone resin was used as the binder.

(Making of Preliminary Bodies of Example 1 and Comparative Examples 1 and 2)

A preliminary body was formed from the slurry of each of Example 1 and Comparative Examples 1 and 2. In detail, the slurry is applied on a PET film by using a doctor blade method. Thereafter, drying was performed in a drying furnace under a temperature of about 70° C. As a result of the drying, the solvent was removed, and the preliminary body was made. The thus-made preliminary body had a thickness of 200 μm.

(Making of Molded Bodies of Example 1 and Comparative Examples 1 and 2)

The preliminary body of each of Example 1 and Comparative Examples 1 and 2 is cut by using trimming die so that a plurality of square sheets each having a width of 65 mm and a length of 65 mm were obtained. For each of Example 1 and Comparative Examples 1 and 2, a predetermined number of the sheets was stacked on each other to make a stacked body. The thus-made stacked body was pressed in a die under a room temperature by pressure of 6 t/cm$^2$. The stacked body pressed under a room temperature was then hot pressed under a temperature of 170° C. by pressure of 80 kgf/cm$^2$ so that a molded plate having a thickness of 1.2 mm was made. The thus-made molded plate was processed by using a milling machine so that a molded body of each of Example 1 and Comparative Examples 1 and 2 was made. Each of the molded bodies had a toroidal shape having an outer diameter of 13 mm and an inner diameter of 8 mm.

(Making of Dust Cores of Example 1 and Comparative Examples 1 and 2)

A heat-treatment was applied to the molded body of each of Example 1 and Comparative Examples 1 and 2 in the atmosphere so that a dust core of each of Example 1 and Comparative Examples 1 and 2 was made. In the heat-treatment, debinding time was 7 hours, and heating time was 2.5 hours. In the heat-treatment of each of Example 1 and Comparative Example 2, the temperature of the molded body was raised, and then the molded body was held at a maximum holding temperature of 850° C., or a holding temperature up to 850° C., for 1.5 hours. On the other hand, the molded body of Comparative Example 1 was held at a maximum holding temperature of 650° C., or a holding temperature up to 650° C., for 1.5 hours after the temperature of the pressure-molded body was raised.

The dust core of each of Example 1 and Comparative Examples 1 and 2 which was made as described above was cut along a vertical plane, and observation was made about a thickness of the metal particle in the magnetic core and existence of the predetermined hole of the metal particle. The observation result is shown in Table 1.

TABLE 1

| | composition | thickness of metal particle [μm] | existence of predetermined hole |
|---|---|---|---|
| Example 1 | FeSiAl-base | 2 | observed |
| Comparative Example 1 | FeSiAl-base | 2 | not observed |
| Comparative Example 2 | FeSiCr-base | 0.5 | not observed |

Referring to Table 1, the dust core of Example 1 contained flat particles (metal particles) each of which was made of FeSiAl alloy and was formed with a large number of the predetermined holes because the molded body was held at a high temperature of 850° C. In contrast, the dust core of Comparative Example 1 contained no metal particle which was formed with the predetermined hole because the molded body was held at a relatively low temperature of 650° C. In detail, although the circumference of the metal particle was formed with narrow holes, no relatively wide hole satisfying the size condition of the predetermined hole was formed. Moreover, the dust core of Comparative Example 2, which was formed of flat particles (metal particles) each made of FeSiCr alloy, contained no metal particle which was formed with the predetermined hole although the molded body was held at a high temperature of 850° C. The aforementioned result shows that the composition including Al element and the holding temperature are important for formation of the predetermined hole.

Core loss and DC superimposition characteristics of the dust core of each of Example 1 and Comparative Examples 1 and 2 were measured. The measurement result is shown in Table 2 and FIG. 10.

TABLE 2

| | core loss [mW/cc] (5 MHz, 5 mT) | H70 [Oe] | $\mu'_0 \times$ H70 |
|---|---|---|---|
| Example 1 | 90 | 48 | 3300 |
| Comparative Example 1 | 270 | 6 | 1300 |
| Comparative Example 2 | 560 | 26 | 1000 |

Figure 10:
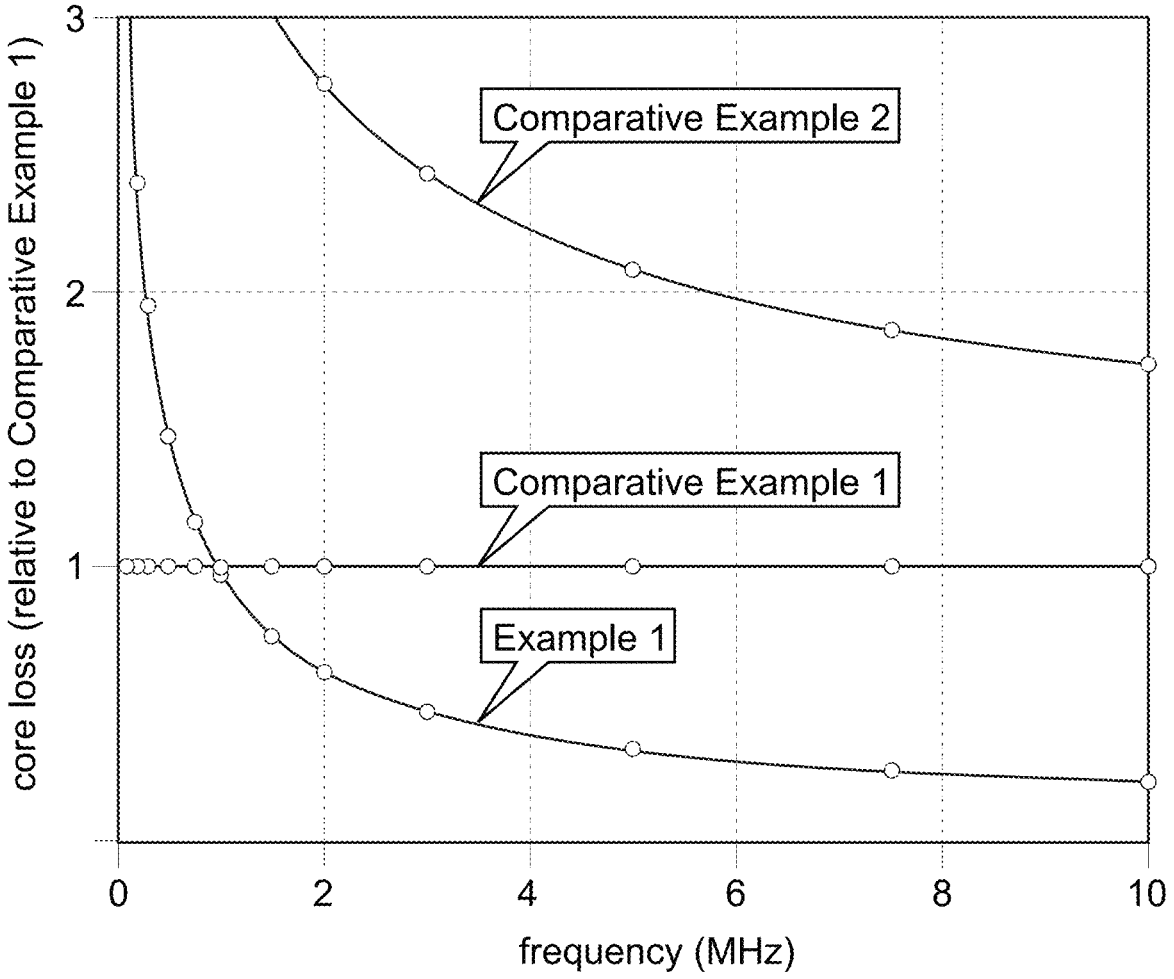
FIG. 10 is a view showing core loss of Example and Comparative Examples of the present invention.

Referring to Table 2 and FIG. 10, according to Example 1, because the flat metal particles are formed with the predetermined holes, each of the metal particles works as the flat-plate structure including high density of imaginary sphere particles. Thus, the magnetic domain of each of the flat particles is made fine, and thereby core loss in high-frequency range between 1 MHz and 10 MHz is reduced in comparison with the flat particles of each of Comparative Examples 1 and 2 which are formed with no predetermined hole.

Referring to Table 2, "H70" shows magnitude of magnetic field under a condition where permeability is reduced by 30% in comparison with relative permeability (initial permeability: μ'0) under another condition where no magnetic field is applied. "μ'0×H70" is the initial permeability multiplied by H70, and DC superimposition characteristics are considered to be more superior as this value (μ'0×H70) is larger. According to Comparative Example 1, the dust core made of the flat particles has high inductance, but its inductance is rapidly degraded when magnetic field is applied. In contrast, according to Example 1, because of the aforementioned flat-plate structure, DC superimposition characteristics intermediated between those of the flat particles and those of the sphere particles can be obtained. As a result, the permeability of the dust core of Example 1 is hardly degraded in comparison with those of the dust cores of Comparative Examples 1 and 2 when magnetic field is applied.

Summarizing the consideration described above, a dust core which has low core loss in high-frequency range and good DC superimposition characteristics can be obtained by forming flat particles each made of FeSiAl alloy into a molded body and by holding the thus-formed molded body at a high temperature in a heat-treatment applied thereto.

The metal particles 20 of Example 1 contained Fe of 83 weight %, Si of 12 weight % and Al of 5 weight %. Similar dust cores were manufactured by the manufacturing method same as that of Example 1 with use of various examples of FeSiAl alloy having various weight ratios. As a result, the effect similar to that of Example 1 was obtained at least in instances where Fe ratio is not less than 70 weight % but not more than 95 weight %, Si ratio is not less than 3 weight % but not more than 18 weight % and Al ratio is not less than 1 weight % but not more than 12 weight %.

(Making of Dust Cores of Examples 2 to 19)

Dust cores of Examples 2 to 5 were made by manufacturing methods different from each other. In the manufacturing methods of the dust cores of Examples 2 to 5, only the maximum holding temperature in the heat-treatment of the molded body of Example 1 was changed within a range of 600° C. to 950° C. in 50° C. increments. In addition, dust cores of Examples 6 to 17 were made by manufacturing methods different from each other. In the manufacturing methods of the dust cores of Examples 6 to 17, a part of or all of the binder of Example 1 was replaced with a $Bi_2O_3$—$B_2O_3$-based glass frit, and the maximum holding temperature in the heat-treatment of the molded body of Example 1 was changed within a range of 600° C. to 950° C. in 50° C. increments. "Mix ratio" of Table 3 shows volume ratio of the glass frit in the binder of each of Examples. In addition, dust cores of Examples 18 and 19 were made by manufacturing methods different from each other. In the manufacturing methods of the dust cores of Examples 18 and 19, all of the binder of Example 1 was replaced with a $P_2O_5$—$R_2O$—$Al_2O_3$-based glass frit (where R is at least one element selected from a group consisting of Li, Na and K), and the maximum holding temperature in the heat-treatment of the pressure molded body of Example 1 was changed within a range of 600° C. to 950° C. in 50° C. increments.

Magnetic properties such as relative permeability of the dust cores of Examples 2 to 19 were measured. The measurement result is shown in Table 3.

TABLE 3

| | mix ratio (%) | maximum holding temperature (° C.) | relative permeability ($\mu'_0$) | $\mu'_0 \times H70$ | resistivity ($\rho$) |
|---|---|---|---|---|---|
| Example 2 | 0 | 750 | 150 | 2400 | $5.0 \times 10^{10}$ |
| Example 3 | | 800 | 110 | 2800 | $5.6 \times 10^{10}$ |
| Example 4 | | 850 | 70 | 3300 | $1.6 \times 10^{9}$ |
| Example 5 | | 900 | 60 | 2000 | $2.8 \times 10^{2}$ |
| Example 6 | 25 | 700 | 140 | 2100 | $3.5 \times 10^{9}$ |
| Example 7 | | 750 | 100 | 2400 | $5.3 \times 10^{9}$ |
| Example 8 | | 800 | 80 | 2900 | $5.9 \times 10^{9}$ |
| Example 9 | | 850 | 70 | 2600 | $1.7 \times 10^{7}$ |
| Example 10 | | 900 | 60 | 2100 | $3.0 \times 10^{2}$ |
| Example 11 | 50 | 700 | 140 | 2200 | $5.1 \times 10^{7}$ |
| Example 12 | | 750 | 110 | 2400 | $5.3 \times 10^{7}$ |
| Example 13 | | 800 | 90 | 2600 | $6.5 \times 10^{7}$ |
| Example 14 | | 850 | 70 | 2100 | $4.0 \times 10^{2}$ |
| Example 15 | 75 | 700 | 130 | 2200 | $5.0 \times 10^{6}$ |
| Example 16 | | 750 | 100 | 2300 | $3.2 \times 10^{3}$ |
| Example 17 | 100 | 650 | 120 | 2000 | $6.6 \times 10^{3}$ |
| Example 18 | 100 | 600 | 100 | 2100 | $6.8 \times 10^{5}$ |
| Example 19 | | 650 | 90 | 2000 | $4.9 \times 10^{3}$ |

Referring to Examples 2 to 5 of Table 3, when only methyl silicone resin was contained in the binder, the predetermined hole was not formed by the maximum holding temperature of 700° C. or less. Although the predetermined hole was formed by the maximum holding temperature of 950° C., resistivity was extremely low, and an available dust core could not be made. Referring to Examples 6 to 17 of Table 3, the maximum holding temperature required for formation of the predetermined hole was gradually lowered from 750° C. to 650° C. as the ratio of the $Bi_2O_3$—$B_2O_3$-based glass frit relative to the binder was higher. Meanwhile, the maximum holding temperature for obtaining required magnetic properties such as resistivity was also gradually lowered from 900° C. to 650° C. Referring to Examples 18 and 19 of Table 3, when the binder was wholly replaced with a $P_2O_5$—$R_2O$—$Al_2O_3$-based glass frit, the predetermined hole was formed and the maximum holding temperature for obtaining required magnetic properties was 600° C. or 650° C. Considering the aforementioned measurement result, the maximum holding temperature required for making the dust core of the present invention is not less than 600° C. but not more than 900° C.

What is claimed is:

1. A compressed powder body comprising metal particles and an interposed substance which is interposed between the metal particles, wherein:

each of the metal particles is made of FeSiAl-based soft magnetic alloy and has a flat shape when seen along a predetermined direction;

the metal particles include one or more of the metal particles each of which is formed with one or more predetermined holes;

each of the predetermined holes passes through the metal particle in the predetermined direction; and each of the predetermined holes has a maximum width in a predetermined plane perpendicular to the predetermined direction, the maximum width being equal to or larger than a thickness of the metal particle with the predetermined hole in the predetermined direction.

2. The compressed powder body as recited in claim 1, wherein the thickness of the metal particle with the predetermined hole is not less than 0.5 μm but not more than 5 μm.

3. The compressed powder body as recited in claim 1, wherein the maximum width of the predetermined hole is not less than 1 μm but not more than 5 μm.

4. The compressed powder body as recited in claim 1, wherein the predetermined hole is hollow.

5. The compressed powder body as recited in claim 1, wherein the predetermined hole has opposite ends in the predetermined direction each of which is covered by a part of the interposed substance.

6. The compressed powder body as recited in claim 1, wherein the interposed substance contains silicon oxide as its main component or is made of glass.

7. The compressed powder body as recited in claim 1, wherein each of the predetermined holes passes completely through the metal particle in the predetermined direction.

* * * * *